US005170831A

United States Patent [19]

Bilt

[11] Patent Number: 5,170,831

[45] Date of Patent: Dec. 15, 1992

[54] AUTOMATIC AUXILIARY HANGAR DOORS AND METHOD

[76] Inventor: Michael M. Bilt, #1 Well Bilt Industrial Drive, Williston Airport, Williston, Fla. 32696

[21] Appl. No.: 856,986

[22] Filed: Mar. 24, 1992

[51] Int. Cl.[5] ..... E06B 3/48

[52] U.S. Cl. ..... 160/115; 160/185; 160/186

[58] Field of Search ..... 160/184, 193, 213, 115, 160/95, 96, 97, 185, 186, 187, 118, 117, 92, 113; 16/76

[56] References Cited

U.S. PATENT DOCUMENTS

| | | | |
|---|---|---|---|
| 3,760,861 | 9/1973 | Hammerstrom | 160/184 |
| 3,809,144 | 5/1974 | Garufo | 160/184 |
| 4,124,055 | 11/1978 | Aspenson et al. | 160/193 |
| 4,545,418 | 10/1985 | List et al. | 160/213 |
| 4,637,446 | 1/1987 | McQueen et al. | 160/213 X |
| 4,793,398 | 12/1988 | Hoff et al. | 160/213 |
| 4,971,129 | 11/1990 | Townend | 160/193 X |

*Primary Examiner*—Blair M. Johnson
*Attorney, Agent, or Firm*—Oltman and Flynn

[57] ABSTRACT

A hangar door assembly for passing the vertical stabilizer of an airplane tail, includes a main door frame fitted into a wall of an aircraft hangar building, a main door pivotally mounted within the main door frame, an auxiliary door frame having a vertical edge, and fitted into the hangar building wall above the main door frame, an auxiliary door pivotally mounted on the vertical edge and biased with a spring to swing to an open position, a bearing assembly attached to the main door bearing against the auxiliary door, to oppose the biasing of the spring to close the auxiliary door when the main door is slid closed. A method for opening an auxiliary door as described above includes the steps of sliding the main door to an open position, thereby gradually moving the bearing assembly toward the vertical edge, keeping the auxiliary door in contact with the bearing assembly as the bearing assembly moves toward the vertical edge with the spring, thereby gradually opening the auxiliary door. A method for closing the auxiliary door described above includes the steps of sliding the main door to a closed position, thereby gradually moving the bearing assembly along the auxiliary door and away from the vertical edge, keeping the auxiliary door in contact with the bearing assembly as the bearing assembly moves away from the vertical edge with the spring, thereby gradually closing the auxiliary door.

6 Claims, 2 Drawing Sheets

FIG. 1
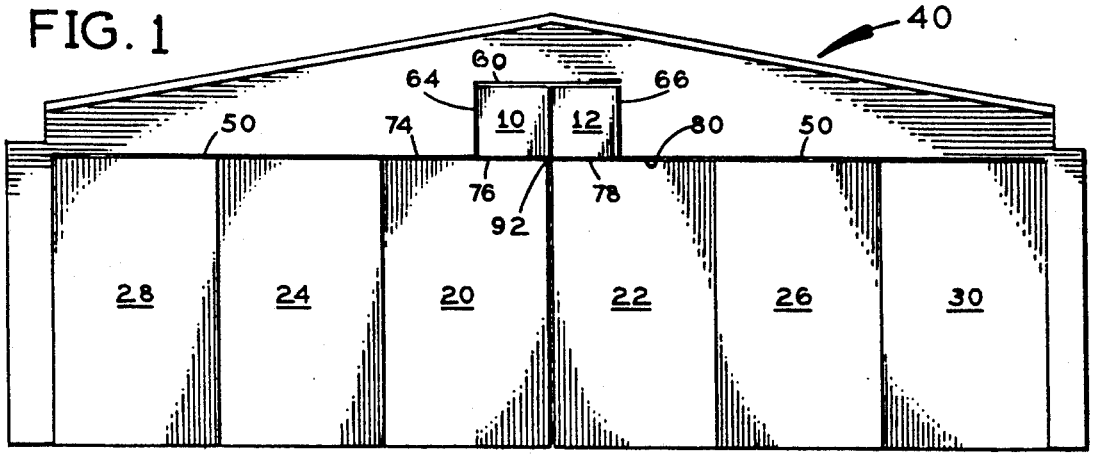
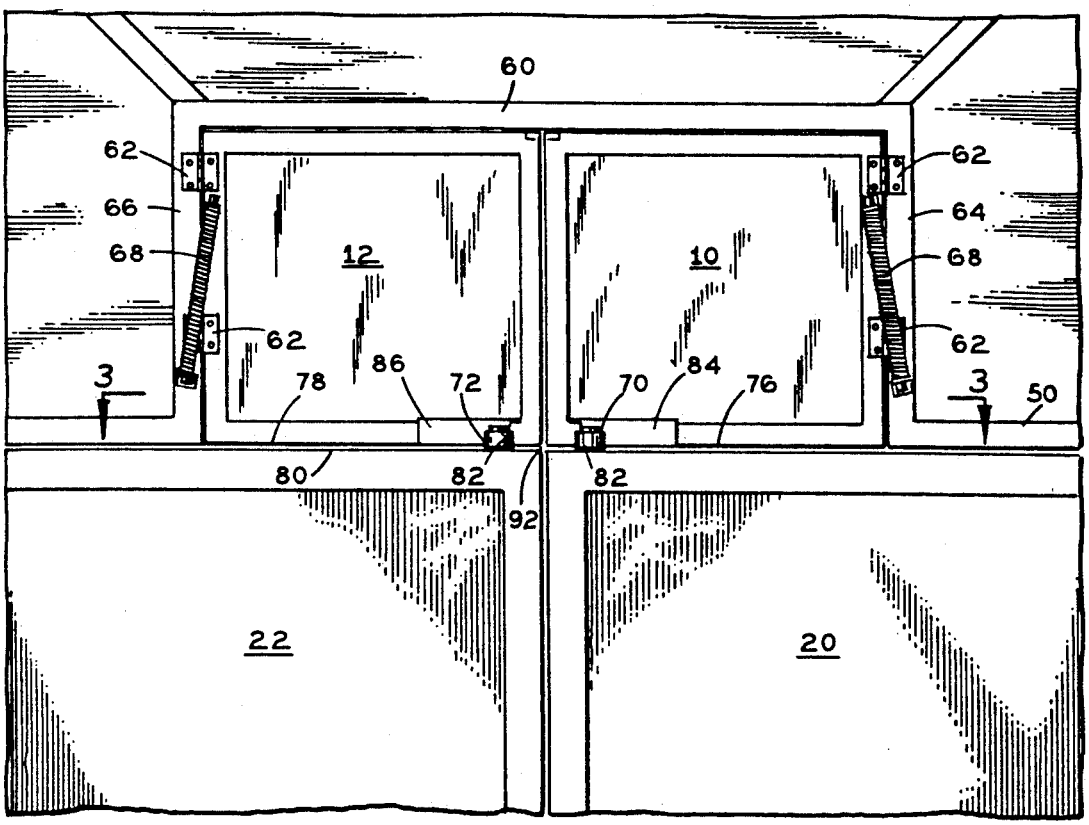
FIG. 2
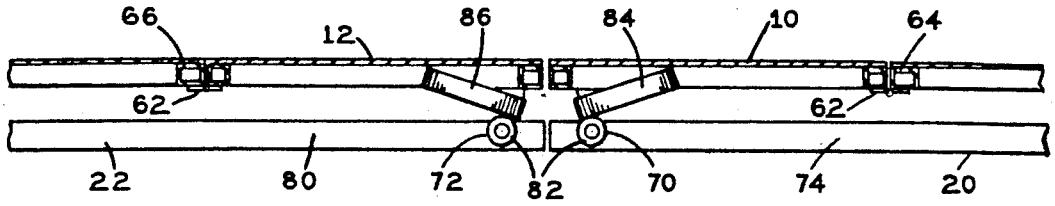
FIG. 3

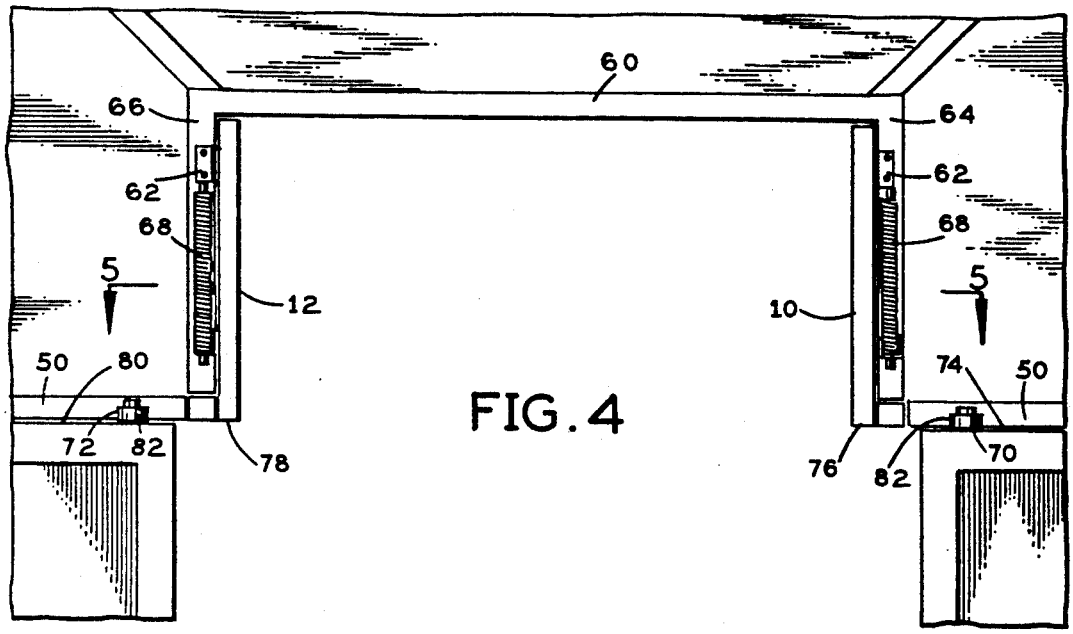
FIG. 4
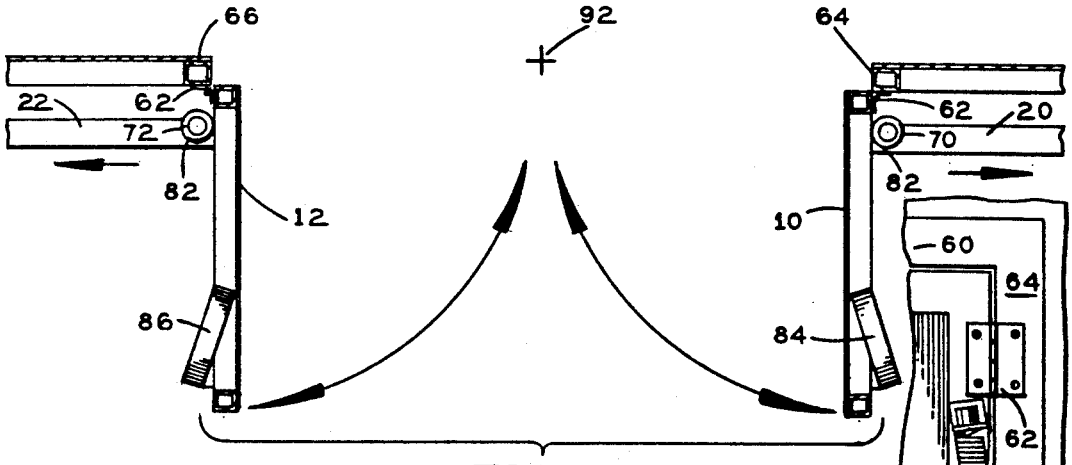
FIG. 5
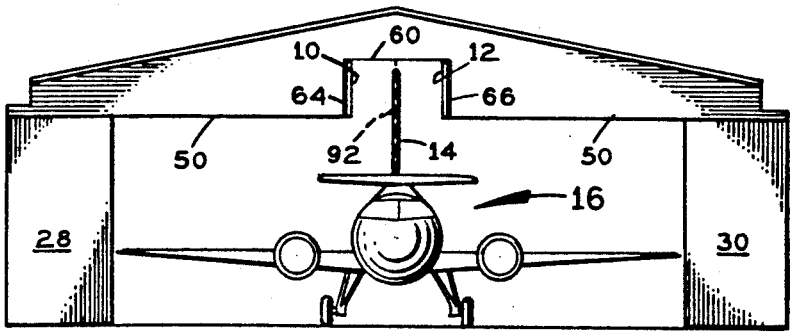
FIG. 7
FIG. 6

AUTOMATIC AUXILIARY HANGAR DOORS AND METHOD

BACKGROUND OF THE INVENTION

1. Field of the Invention

The present invention relates generally to the field of doors on hangars for admitting airplanes, and more specifically to a pair of auxiliary hangar doors for use in conjunction with and located above the center of sliding main hangar doors, for admitting the vertical stabilizer of an airplane tail, the auxiliary hangar doors being spring-biased to an open position, and alternately pushed closed and released to open by bearing assemblies attached to the top of the main hangar doors and riding against the lower edges of the auxiliary hangar doors to oppose the spring biasing so that the main and auxiliary hangar doors open and close in unison.

2. Description of the Prior Art

There have long been structures referred to as hangars for sheltering airplanes and their maintenance crews from the elements. These hangars have necessarily had large doors to permit airplane entry and exit. Sliding doors have been preferred, because hangar doors are so large that a substantial area in front of the hangar would have to be kept clear if they opened out on hinges. A problem has been that the vertical stabilizers of airplane tails extend significantly higher than the rest of the airplane.

Hangars often have peaked roofs which receive the stabilizers at their highest point. However, the slant of the roof toward either side of the front gable wall of a hangar limits the height of the hangar doors to a level at or below the lowest roof elevations at the sides. It is not economical to build hangars for light aircraft which are tall enough for the stabilizer to clear the top of the doorway with the airplane in its normal position. As a result, workers handling airplanes must often struggle to pull the tail portion down while the plane is pushed into the hangar. The inconvenience of this operation is multiplied many times at large and busy airports where airplanes are moved into and out of hangars several times a day. It is almost inevitable that workers will become rushed or careless at some point and permit the stabilizer to strike the hangar door frame, damaging both the airplane and the door frame.

The only prior art attempt to solve this problem appears to be that of Townend, U.S. Pat. No. 4,971,129, issued on Nov. 20, 1990. Townend teaches a pair of hangar doors fitted into the gable end of a hangar having a peaked roof. The top edges of each door and the door frame are angled to follow the line of the roof and form a peak of their own. Each door is hinged along its top edge and is divided into upper and lower panels, the top edge of the lower panel being hingedly connected to the bottom edge of the upper panel and being angled parallel to the upper panel top edge. A motorized beam framework fastened to the inside faces of the panels, causes the upper panel to pivot upward into a horizontal position while the lower panel remains vertically suspended therefrom. The angled mounting of the doors not only permits the door frame to be higher at its center but also causes the doors to separate somewhat as they open. The resulting space between the vertical lower panels is sufficient to receive the vertical stabilizer of an airplane.

A problem with Townend is that an existing hangar would have to be modified very substantially to accommodate the angled doors, and the existing doors discarded at a loss. Even if a hangar were fitted with the Townend doors when built, the doors and their support structures would be complicated and costly. Another problem is that, since the doors swing outward, an additional area in front of the hangar must be kept clear, and thereby loses its utility. Still another problem is that, apart from the open center space for the stabilizer, the Townend doors do not provide as tall an opening as do conventional sliding doors. Finally, a structural defect could cause the heavy, elevated doors to fall on workers and the aircraft.

It is thus an object of the present invention to provide a hangar door arrangement for passing airplane vertical stabilizers, which can be easily and inexpensively added to conventional sliding hangar doors.

It is another object of the present invention to provide such a door arrangement wherein the utility of Tarmac space immediately in front of the hangar is not sacrificed.

It is still another object of the present invention to provide such a door arrangement which is simple in design and reliable.

It is finally an object of the present invention to provide such a door arrangement which offers maximum safety.

SUMMARY OF THE INVENTION

The present invention accomplishes the above-stated objectives, as well as others, as may be determined by a fair reading and interpretation of the entire specification.

A hangar door assembly is provided for passing the vertical stabilizer of an airplane tail, including a main door frame fitted into a wall of an aircraft hangar building, a main door slidingly mounted within the main door frame, an auxiliary door frame having a vertical edge, and fitted into the hangar building wall above the main door frame, an auxiliary door hingedly mounted on the vertical edge and biased with a spring to swing to an open position, a bearing assembly attached to the main door and bearing against the auxiliary door, to oppose the biasing of the spring to close the auxiliary door when the main door is slid closed. The bearing assembly preferably includes a wheel mounted on the main door to rotate on a vertical axis, for bearing against the auxiliary door and minimizing friction between the auxiliary door and the bearing assembly. The auxiliary door has a free end and the hangar door assembly may additionally include a ramp member attached at the free end to act as a spacer between the bearing assembly and the auxiliary door, and permit the bearing assembly to push the auxiliary door completely closed. The spring is preferably a coil spring having a first spring end and a second spring end, attached at the first spring end to the auxiliary frame and at the second spring end to the auxiliary door. Several main doors are preferably provided and are mounted to overlappingly slide within the main door frame, at least one of the main doors being located centrally within the main door frame, and the bearing assembly being attached to the centrally located main door. Moreover, two centrally located main doors are preferably provided and the auxiliary door frame has two vertical edges and contains two auxiliary doors, each auxiliary door being hingedly mounted to one of the vertical edges so that the auxiliary doors swing apart when opened and swing together when closed, and two bearing assemblies are provided, each being attached to one of the centrally located main doors and bearing against one of the auxiliary doors.

A method is provided for opening an auxiliary door as described above and includes the steps of sliding the main door to an open position, thereby gradually moving the bearing assembly toward the vertical edge, keeping the auxiliary door in contact with the bearing assembly as the bearing assembly moves toward the vertical edge with the spring, thereby gradually opening the auxiliary door. A method is also provided for closing the auxiliary door described above, including the steps of sliding the main door to a closed position, thereby gradually moving the bearing assembly along the auxiliary door and away from the vertical edge, keeping the auxiliary door in contact with the bearing assembly as the bearing assembly moves away from the vertical edge with the spring, thereby gradually closing the auxiliary door.

BRIEF DESCRIPTION OF THE DRAWINGS

Various other objects, advantages, and features of the invention will become apparent to those skilled in the art from the following discussion taken in conjunction with the following drawings, in which:

FIG. 1 is a front view of an airplane hangar equipped with the inventive auxiliary doors, with the doors in the closed position.

FIG. 2 is a close-up, rear view of the auxiliary doors, as seen from inside the hangar.

FIG. 3 is a cross-sectional top view of the auxiliary doors in the closed position, showing the bearing assemblies and ramp members.

FIG. 4 is a rear view of the auxiliary doors in the open position, showing the biasing springs and a partial view of the central main doors below.

FIG. 5 is a cross-sectional top view of the auxiliary doors in the open position, again showing the bearing assemblies and ramp members.

FIG. 6 is a cut away, close-up view of a biasing spring mounted on a closed auxiliary door.

FIG. 7 is a front view of an airplane hangar with the main and auxiliary doors open and an airplane passing between them.

DETAILED DESCRIPTION OF THE PREFERRED EMBODIMENTS

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various Figures are designated by the same reference numerals.

FIRST PREFERRED EMBODIMENT

Referring to FIGS. 1–7, auxiliary hangar doors 10 and 12 for receiving the vertical stabilizer 14 of an airplane 16 tail are disclosed. Doors 10 and 12 move automatically in cooperation with the sliding main doors 20, 22, 24, 26, 28 and 30 conventionally provided on an airplane hangar 40.

Central main doors 20 and 22 meet each other when they are closed, and they open by sliding behind secondary main doors 24 and 26, which in turn both slide behind outer main doors 28 and 30, within the main door frame 50. See FIG. 1. Auxiliary hangar doors 10 and 12 are mounted within an auxiliary door frame 60 continuous with and extending above the center of main door frame 50. Doors 10 and 12 are joined to frame 60 by hinges 62 on vertical frame members 64 and 66. See FIG. 2. Each door 10 and 12 is biased to swing into hangar 40 to an open position by a spring 68 fastened to frame members 64 and 66, respectively.

Doors 10 and 12 are opened and closed by the movement of bearing assemblies 70 and 72 along bottom edges 76 and 78 of doors 10 and 12, and are attached to the upper edges 74 and 80 of central main doors 20 and 22, respectively. See FIGS. 2,3,4 and 5. A bearing wheel 82 is preferably provided on each bearing assembly 70 and 72 so that they can ride against doors 10 and 12 with minimal friction resistance and wear. Bearing assemblies 70 and 72 are preferably spaced away from frame 60, as shown in FIG. 3, to permit gradual opening and closing of doors 10 and 12. Ramp members 84 and 86 are provided on doors 10 and 12 to compensate for this spacing and to permit bearing assemblies 70 and 72 to push doors 10 and 12 completely closed. See FIG. 3.

Method

In practicing the invention, the following method may be used. As main doors 20 and 22 are slid closed, bearing assemblies 70 and 72 converge toward the midpoint 92 of frame 60. As bearing assemblies 70 and 72 move toward midpoint 92, their wheels 82 ride against door bottom edges 76 and 78, gradually pushing doors 10 and 12 into a closed position. See FIGS. 3 and 5.

As main doors 20 and 22 are slid open, bearing assemblies 70 and 72 diverge away from midpoint 92, to positions at either side of frame 60. As bearing assemblies 70 and 72 move away from midpoint 92, springs 68 keep doors 10 and 12 pulled against bearing wheels 82, so that doors 10 and 12 open gradually with the progressive divergence of bearing assemblies 70 and 72. Finally, as bearing assemblies 70 and 72 reach and pass vertical frame members 64 and 66, doors 10 and 12 reach a fully open position, perpendicular to frame 60. See FIGS. 4 and 5. In this way, doors 10 and 12 open and close automatically in cooperation with sliding main doors 20–30, and no added step is required for their operation.

It is contemplated that frame 60, bearing assemblies 70 and 72 and doors 10 and 12 can be installed in both existing and new hangars 40. See FIGS. 1 and 7.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A hangar door assembly for passing the vertical stabilizer of an airplane tail, comprising:

a main door frame fitted into a wall of an aircraft hangar building, a main door slidingly mounted within said main door frame, an auxiliary door frame having a vertical edge, and fitted into said hangar building wall above said main door frame, an auxiliary door hingedly mounted on said vertical edge and biased with spring means to swing to an open position, bearing means attached to said main door and bearing against said auxiliary door, to oppose the biasing of said spring means to close said auxiliary door when said main door is slid closed.

2. A hangar door assembly according to claim 1, wherein said bearing means comprise a wheel mounted on said main door to rotate on a vertical axis, for bearing against said auxiliary door and minimizing friction between said auxiliary door and said bearing means.

3. A hangar door assembly according to claim 1, wherein said auxiliary door has a free end, additionally comprising:

ramp means attached at said free end to act as a spacer between said bearing means and said auxiliary door, and permit said bearing means to push said auxiliary door completely closed.

4. A hangar door assembly according to claim 1, wherein said spring means comprise a coil spring having a first spring end and a second spring end, attached at said first spring end to said auxiliary frame and at said second spring end to said auxiliary door.

5. A hangar door assembly according to claim 1, wherein a plurality of main doors are provided and are mounted to overlappingly slide within said main door frame, at least one of said main doors being located centrally within said main door frame, and wherein said bearing means is attached to said centrally located main door.

6. A hangar door assembly according to claim 5, wherein two centrally located main doors are provided and wherein said auxiliary door frame has two vertical edges and wherein two auxiliary doors are provided, each said auxiliary door being hingedly mounted to one of said vertical edges so that said auxiliary doors swing apart when opened and swing together when closed, and wherein two bearing means are provided, each being attached to one of said centrally located main doors and bearing against one of said auxiliary doors.

* * * * *